US009364726B2

(12) United States Patent
Sugimae et al.

(10) Patent No.: US 9,364,726 B2
(45) Date of Patent: Jun. 14, 2016

(54) METAL WOOD CLUB

(71) Applicant: Acushnet Company, Fairhaven, MA (US)

(72) Inventors: Ryuichi Sugimae, Oceanside, CA (US); Gentry Ferguson, Encinitas, CA (US); Daniel Stone, Long Beach, CA (US); Keisuke Yamane, Guangdong (CN)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/282,369

(22) Filed: May 20, 2014

(65) Prior Publication Data

US 2015/0335963 A1 Nov. 26, 2015

(51) Int. Cl.
*A63B 53/04* (2015.01)
*A63B 53/02* (2015.01)

(52) U.S. Cl.
CPC ..... *A63B 53/0466* (2013.01); *A63B 53/02* (2013.01); *Y10T 29/49828* (2015.01)

(58) Field of Classification Search
CPC ..... A63B 53/02; A63B 53/0466
USPC ..... 473/257, 305–315, 324, 345, 346
See application file for complete search history.

(56) References Cited

U.S. PATENT DOCUMENTS 2,067,556 A * 1/1937 Wettlaufer ..... 473/308
2,146,321 A * 2/1939 Wettlaufer ..... 473/306
4,417,731 A * 11/1983 Yamada ..... A63B 53/02 473/309
4,854,582 A * 8/1989 Yamada ..... 473/309
4,948,132 A * 8/1990 Wharton ..... 473/246
5,039,098 A * 8/1991 Pelz ..... 473/306
5,042,806 A * 8/1991 Helmstetter ..... 473/311
5,540,435 A * 7/1996 Kawasaki ..... 473/309
5,575,723 A * 11/1996 Take et al. ..... 473/305
5,755,627 A * 5/1998 Yamazaki et al. ..... 473/345
5,839,973 A * 11/1998 Jackson ..... 473/305
5,851,155 A * 12/1998 Wood et al. ..... 473/246
5,888,149 A * 3/1999 Allen ..... 473/309
5,906,549 A * 5/1999 Kubica ..... 473/314
5,931,742 A * 8/1999 Nishimura et al. ..... 473/305
6,193,614 B1 * 2/2001 Sasamoto et al. ..... 473/329
6,251,028 B1 * 6/2001 Jackson ..... 473/305
6,260,250 B1 7/2001 Hall et al.
6,368,230 B1 * 4/2002 Helmstetter ..... A63B 53/02 473/244
6,381,828 B1 * 5/2002 Boyce et al. ..... 29/527.4
6,419,593 B1 * 7/2002 Heinrich et al. ..... 473/324
6,524,194 B2 2/2003 McCabe
6,634,958 B1 * 10/2003 Kusumoto ..... 473/310
6,648,773 B1 * 11/2003 Evans ..... 473/342
6,849,002 B2 * 2/2005 Rice ..... A63B 53/02 473/244
7,063,628 B2 * 6/2006 Reyes et al. ..... 473/324

(Continued)

*Primary Examiner* — William Pierce
(74) *Attorney, Agent, or Firm* — Kevin N. McCoy

(57) ABSTRACT

A method of constructing a golf club head, comprising affixing a hosel to a shell, wherein said shell comprises a striking face, a sole extending aftward from a lower edge of said ball striking face, and a crown extending aftward from an upper edge of said ball striking face, wherein said shell defines a golf club head interior within said shell, wherein said hosel is configured to receive a golf club shaft, wherein said hosel comprises an internal portion within said golf club head interior and an external portion extending outside said shell, wherein said golf club head comprises a hosel rib affixed to said internal portion of said hosel, manipulating the orientation of said hosel relative to said shell after affixing said hosel to said shell, and affixing said hosel rib to said shell after manipulating the orientation of said hosel.

20 Claims, 8 Drawing Sheets

(56) References Cited

U.S. PATENT DOCUMENTS

| | | | | |
|---|---|---|---|---|
| 7,749,095 | B2 * | 7/2010 | Nishitani | A63B 53/02 473/305 |
| 7,824,277 | B2 * | 11/2010 | Bennett et al. | 473/328 |
| 8,066,580 | B2 * | 11/2011 | Conway | 473/218 |
| 2002/0004426 | A1 * | 1/2002 | Lin et al. | 473/324 |
| 2002/0137576 | A1 * | 9/2002 | Dammen | 473/336 |
| 2003/0157995 | A1 * | 8/2003 | Mahaffey | 473/342 |
| 2004/0063515 | A1 * | 4/2004 | Boone | 473/305 |
| 2004/0077433 | A1 * | 4/2004 | Blankenship | 473/308 |
| 2004/0198530 | A1 * | 10/2004 | Poynor | 473/305 |
| 2005/0020376 | A1 * | 1/2005 | Huang | 473/324 |
| 2005/0032583 | A1 * | 2/2005 | Chiu | 473/308 |
| 2005/0101402 | A1 * | 5/2005 | Kawakami | 473/305 |
| 2005/0215345 | A1 * | 9/2005 | Kawakami et al. | 473/305 |
| 2005/0282655 | A1 * | 12/2005 | Sasaki | 473/324 |
| 2006/0046869 | A1 * | 3/2006 | Galloway | 473/345 |
| 2006/0199661 | A1 * | 9/2006 | Deng et al. | 473/324 |
| 2006/0211514 | A1 * | 9/2006 | Deshmukh | 473/342 |
| 2010/0035701 | A1 * | 2/2010 | Kusumoto | 473/307 |
| 2010/0087269 | A1 * | 4/2010 | Snyder et al. | 473/329 |
| 2010/0234136 | A1 * | 9/2010 | Nishitani | A63B 53/02 473/345 |
| 2011/0151995 | A1 * | 6/2011 | Evans | 473/328 |
| 2011/0190073 | A1 * | 8/2011 | Bennett et al. | 473/345 |
| 2011/0312437 | A1 * | 12/2011 | Sargent et al. | 473/335 |
| 2012/0034996 | A1 * | 2/2012 | Murphy et al. | 473/307 |
| 2012/0088598 | A1 * | 4/2012 | Lo et al. | 473/307 |
| 2012/0100926 | A1 * | 4/2012 | Golden et al. | 473/307 |
| 2012/0122601 | A1 * | 5/2012 | Beach et al. | 473/248 |
| 2012/0157229 | A1 * | 6/2012 | Takechi | 473/345 |
| 2013/0017901 | A1 * | 1/2013 | Sargent et al. | 473/309 |
| 2013/0123038 | A1 * | 5/2013 | Cole et al. | 473/307 |
| 2014/0080617 | A1 * | 3/2014 | Llewellyn et al. | 473/246 |
| 2014/0162807 | A1 * | 6/2014 | Touchette | 473/314 |
| 2014/0187346 | A1 * | 7/2014 | Beno et al. | 473/332 |
| 2014/0274454 | A1 * | 9/2014 | Snyder | 473/332 |
| 2014/0357398 | A1 * | 12/2014 | Yamamoto | 473/305 |
| 2015/0031469 | A1 * | 1/2015 | Yamasawa et al. | 473/307 |

* cited by examiner

METAL WOOD CLUB

TECHNICAL FIELD

This present technology generally relates to systems, devices, and methods related to golf clubs, and more specifically to metal wood clubs including a hosel incorporating a hosel rib.

DESCRIPTION OF THE RELATED TECHNOLOGY

Multi-piece construction metal wood golf clubs generally include a plurality of pieces which are joined together to form a golf club head. One of those pieces includes the hosel, the portion of the golf club head configured to receive the shaft of the golf club. In some golf club heads, the plurality of pieces also includes a face cup, a crown, and a sole. The plurality of pieces can be welded together to form the golf club head. Lie angle, face angle, and loft angle, are a few characteristics of a golf club head which a manufacturer desires to keep within tolerance during manufacturing.

The lie angle of any golf club is the angle formed between the center of the shaft and the ground line of the golf club when the club is soled in its proper playing position. Face angle is the angle of the face of the club relative to the target. If the club head is "square," the clubface will be directly facing the target on address. A "closed" face will be aligned to the left of the target (for right-handed players). If it is "open," the face will be aligned to the right of the target. Loft angle is a measurement, in degrees, of the angle at which the face of the club lies relative to a perfectly vertical face. Using a club with a high loft angle will typically result in a golf shot with a high initial trajectory. In contrast, utilizing a club with a low loft angle will typically result in a golf shot with a low initial trajectory.

Devices have been developed for bending the hosel of the golf club head. The devices generally include some form of vise or clamp and may include a bending tool and/or gauge to measure the angle or bend in at least one axis or plane. U.S. Pat. No. 6,260,250 generally discloses a bending plate to be used in conjunction with a conventional clamping apparatus in order to apply force to the hosel region of the club head in order to vary the lie and/or loft angle of the golf club head. As discussed in U.S. Pat. No. 6,260,250, the force to the hosel is applied using a tool well known in the golf club manufacturing industry.

SUMMARY

The systems, methods, and devices described herein have innovative aspects, no single one of which is indispensable or solely responsible for their desirable attributes. Without limiting the scope of the claims, some of the advantageous features will now be summarized.

One aspect of the present technology is the realization that during welding of the golf club head, portions of the golf club head can distort, causing face angle, loft, and lie angle to be out of specification. As a result, the hosel needs to be bent relative to the rest of the golf club head after welding in order for face angle, loft, and lie angle to fall within specification. In addition, some golf club head constructions can preferably include a hosel rib bridging the gap between a portion of the hosel and a portion of the golf club head. However, a hosel rib can limit the bending of the hosel relative to the golf club head after welding. Thus, there exists a need for an improved golf club head design incorporating a hosel rib but allowing for bending of the hosel relative to the rest of the golf club head after welding. The present technology is directed to systems, devices, and methods related to golf clubs, and more specifically to metal wood clubs including a hosel with a rib extending from a portion of the hosel. The construction of the golf club head incorporates a hosel rib construction providing the ability to bend the hosel relative to the rest of the golf club head after welding the multi-piece golf club head together.

One non-limiting embodiment of the present technology includes a method of constructing a golf club head, comprising affixing a hosel to a shell; wherein said shell comprises a striking face, a sole extending aftward from a lower edge of said ball striking face, and a crown extending aftward from an upper edge of said ball striking face; wherein said shell defines a golf club head interior within said shell; wherein said hosel is configured to receive a golf club shaft; wherein said hosel comprises an internal portion within said golf club head interior and an external portion extending outside said shell; wherein said golf club head comprises a hosel rib affixed to said internal portion of said hosel; manipulating the orientation of said hosel relative to said shell after affixing said hosel to said shell; and affixing said hosel rib to said shell after manipulating the orientation of said hosel.

In an additional non-limiting embodiment of the present technology said shell comprises a rib window aligned with said hosel rib and configured to receive at least a portion of said hosel rib.

In an additional non-limiting embodiment of the present technology at least a portion of said hosel rib extends into said rib window and affixing said hosel rib to said shell comprises affixing said portion of said hosel rib extending into said rib window to a portion of said shell adjacent said rib window.

In an additional non-limiting embodiment of the present technology at least a portion of said hosel rib extends outside said shell of said golf club head and said method of constructing a golf club head further comprises removing said portion of said hosel rib extending outside said shell of said golf club head.

An additional non-limiting embodiment of the present technology includes the marriage of a plurality of pieces to form said shell.

In an additional non-limiting embodiment of the present technology said marriage comprises welding said plurality of pieces together, wherein affixing said hosel to said shell comprises welding said hosel to said shell, and wherein said marriage occurs prior to said manipulation of the orientation of said hosel relative to said shell.

In an additional non-limiting embodiment of the present technology affixing said hosel rib to said shell comprises welding said hosel rib to said shell and wherein said method of constructing said golf club head further comprises a finishing process.

In an additional non-limiting embodiment of the present technology said hosel rib substantially limits the orientation of said hosel from changing relative to said shell after said hosel rib is affixed to said shell.

In an additional non-limiting embodiment of the present technology affixing said hosel rib to said shell comprises affixing said hosel rib to said sole.

In an additional non-limiting embodiment of the present technology said hosel rib extends away from said hosel in a substantially heelward direction.

In an additional non-limiting embodiment of the present technology said hosel rib is configured to manipulate the acoustic qualities of said golf club head.

In an additional non-limiting embodiment of the present technology said hosel rib is substantially rectangular in cross section.

In an additional non-limiting embodiment of the present technology said plurality of pieces forming said shell comprise a face cup, a sole, and a crown, wherein said face cup comprises a striking face, an upper face cup return, and a lower face cup return.

An additional non-limiting embodiment of the present technology includes a method of constructing a golf club head, comprising affixing a hosel to a shell; wherein said shell comprises a striking face, a sole extending aftward from a lower edge of said ball striking face, and a crown extending aftward from an upper edge of said ball striking face; wherein said shell defines a golf club head interior within said shell; wherein said hosel is configured to receive a golf club shaft; wherein said hosel comprises an internal portion within said golf club head interior and an external portion extending outside said shell; wherein said golf club head comprises a hosel rib affixed to said internal portion of said hosel; wherein said shell comprises a plurality of affixation ports, said affixation ports comprising holes passing through said shell; manipulating the orientation of said hosel relative to said shell after affixing said hosel to said shell; affixing said hosel rib to said shell after manipulating the orientation of said hosel; and wherein affixing said hosel rib to said shell comprises adding a spot weld to each affixation port, at least one of said spot welds engaging said hosel rib.

An additional non-limiting embodiment of the present technology includes a golf club head, comprising a shell comprising a striking face; a sole extending aftward from a lower edge of said ball striking face; a crown extending aftward from an upper edge of said ball striking face; a golf club head interior within said shell; a hosel affixed to a heel side of said shell, said hosel configured to receive a golf club shaft; wherein said hosel comprises an internal portion extending into said golf club head interior and an external portion extending outside said shell; and a hosel rib affixed to said internal portion of said hosel and to said shell.

In an additional non-limiting embodiment of the present technology said hosel rib substantially limits the orientation of said hosel from changing relative to said shell.

In an additional non-limiting embodiment of the present technology said hosel rib is affixed to said sole.

In an additional non-limiting embodiment of the present technology said shell comprises a plurality of pieces welded together and wherein said hosel is welded to said shell at a shell engaging hosel portion defining the border between said internal portion of said hosel and said external portion of said hosel.

In an additional non-limiting embodiment of the present technology said hosel rib is welded to said shell.

In an additional non-limiting embodiment of the present technology said internal portion of said hosel does not directly engage said shell, and wherein said internal portion of said hosel indirectly engages said shell via said hosel rib.

BRIEF DESCRIPTION OF THE DRAWINGS

The accompanying drawings form a part of the specification and are to be read in conjunction therewith. The illustrated embodiments, however, are merely examples and are not intended to be limiting. Like reference numbers and designations in the various drawings indicate like elements.

DETAILED DESCRIPTION

Figure 1:
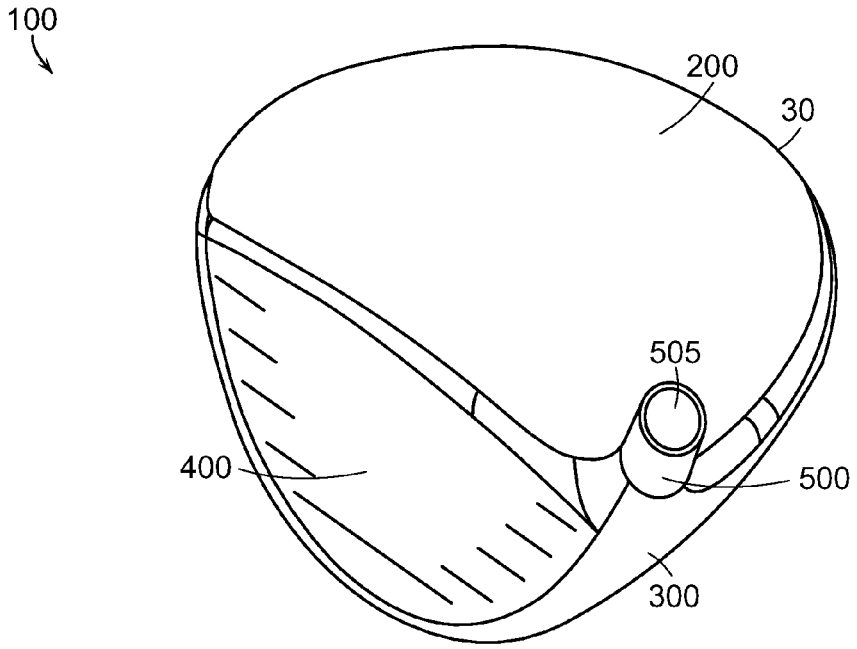
FIG. 1 illustrates a perspective view of one embodiment of a golf club head.
Figure 2:
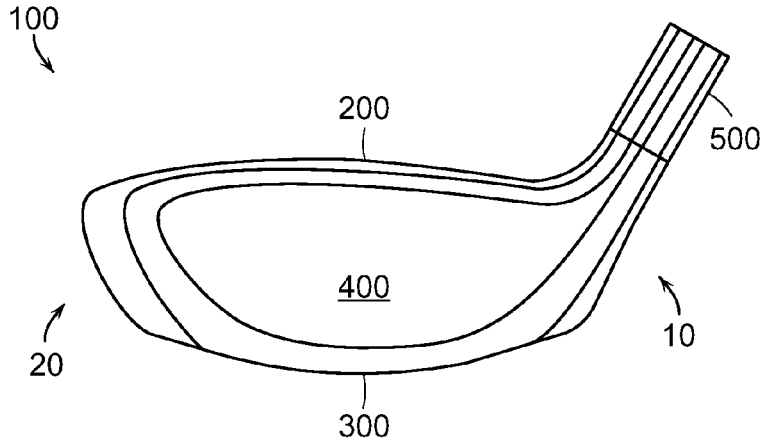
FIG. 2 illustrates a front view of the golf club head of FIG. 1.
Figure 3:
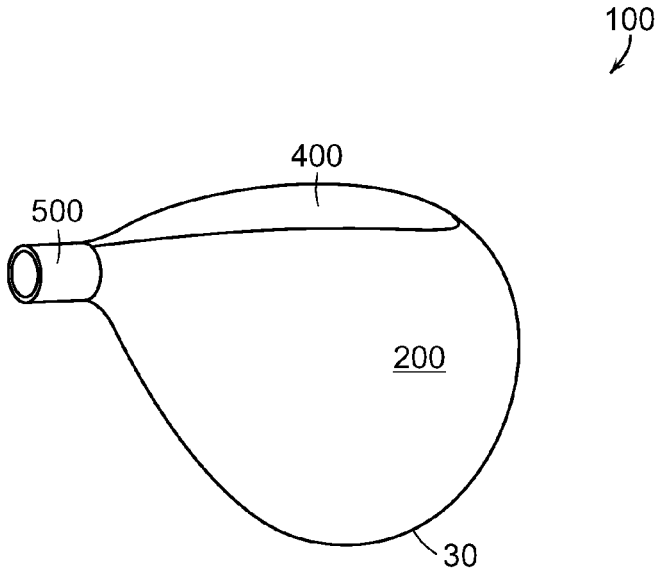
FIG. 3 illustrates a top view of the golf club head of FIG. 1.
Figure 4:
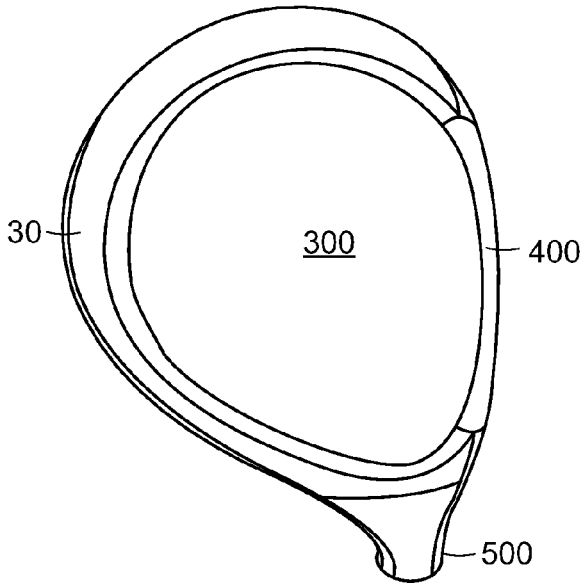
FIG. 4 illustrates a bottom view of the golf club head of FIG. 1.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further and further modifications of inventive features illustrated herein, and additional applications of the principles of the inventions as illustrated herein, which would occur to one skilled in the relevant art and having possession of this disclosure, are to be considered within the scope of the invention.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

In describing the present technology, the following terminology may have been used: The singular forms "a," "an," and "the" include plural referents unless the context clearly dictates otherwise. Thus, for example, reference to an item includes reference to one or more items. The term "plurality" refers to two or more of an item. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. A plurality of items may be presented in a common list for convenience. However, these lists should be construed as though each member of the list is individually identified as a separate and unique member. Thus, no individual member of such list should be construed as a de facto equivalent of any other member of the same lists solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to a selection of one of two or more alternatives, and is not intended to limit the selection of only those listed alternative or to only one of the listed alternatives at a time, unless the context clearly indicated otherwise.

Features of the present disclosure will become more fully apparent from the following description and appended claims, taken in conjunction with the accompanying drawings. After considering this discussion, and particularly after reading the section entitled "Detailed Description" one will understand how the illustrated features serve to explain certain principles of the present disclosure.

Embodiments described herein generally relate to systems, devices, and methods related to golf clubs, and more specifically to metal wood clubs including a hosel with a hosel rib extending from a portion of the hosel.

FIGS. 1-4 illustrate one embodiment of a golf club head 100. The golf club head 100 includes a crown 200, a sole 300, a striking face 400, and a hosel 500. The hosel 500 is the portion of the golf club head 100 configured to receive the shaft of the golf club, coupling the shaft to the golf club head 100. The hosel 500 can include a shaft bore 505 configured to receive a portion of the shaft. The hosel 500 is generally located on the heel side 10 of the golf club head 100 which is opposite the toe side 20. The striking face 400 is located at the front of the golf club head 100 and is configured to impact the golf ball when the golf club is swung. The sole 300 is located at the bottom of the golf club head 100 and the crown 200 is located at the top of the golf club head 100. The golf club head 100 includes an aft portion 30 at the rear of the golf club head 100 opposite the striking face 400.

Figure 13:
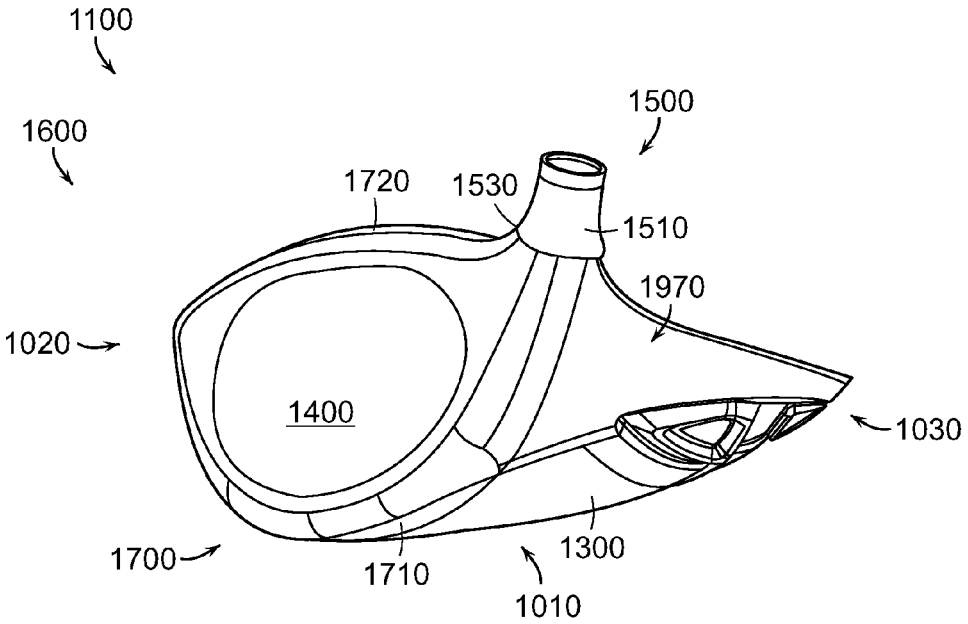
FIG. 13 illustrates an additional perspective view of the golf club head of FIG. 11 after a finishing process.
Figure 14:
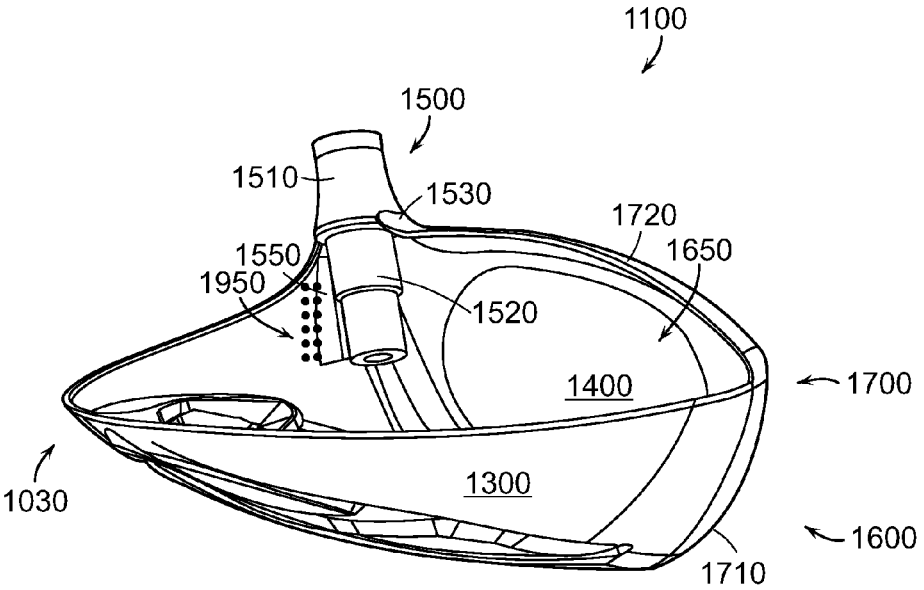
FIG. 14 illustrates an additional perspective view of the golf club head of FIG. 11 with the hosel rib affixed to the shell.
Figure 15:
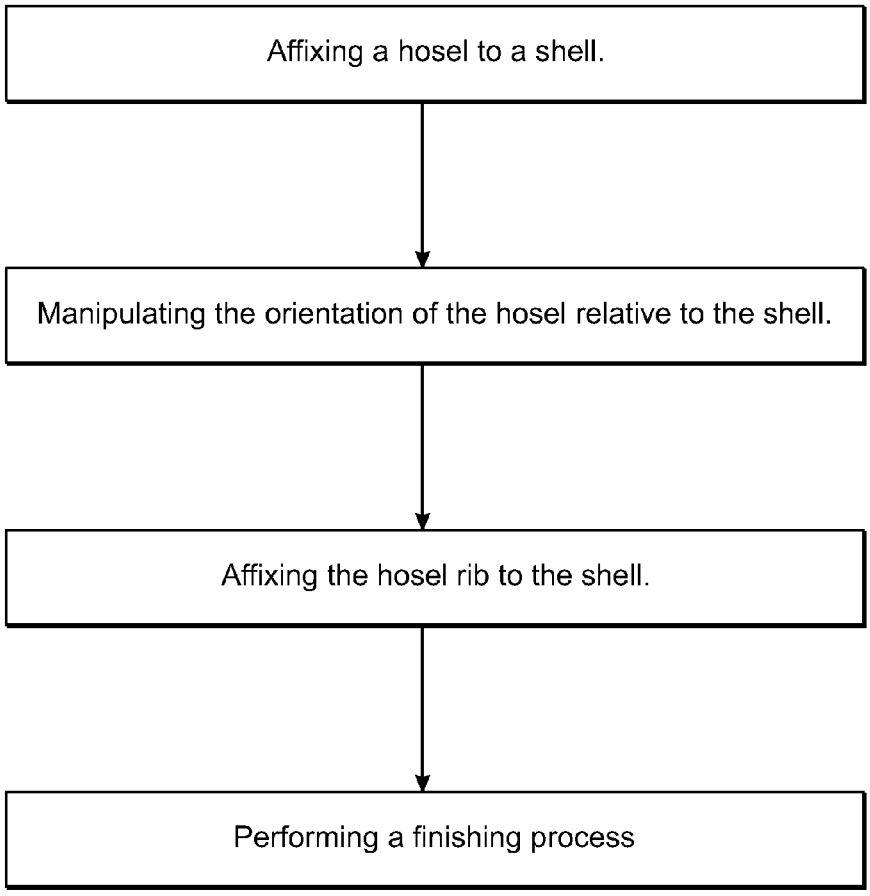
FIG. 15 illustrates a flow chart outlining one embodiment of a method of constructing a golf club head.

In some embodiments, the golf club head 1100 can comprise a multi-piece construction, meaning that the golf club head 1100 comprises a plurality of pieces, which may include for example a face cup 1700, sole 1300, crown, and hosel 1500, which are formed separately, and then joined together to form a golf club head 1100, which can be referred to as a marriage. FIGS. 5-14 illustrate embodiments of a golf club head 1100 comprising multi-piece construction. It is important to note that the embodiments illustrated in FIGS. 5-14 do not illustrate the crown of the golf club head 1100 to provide an uninhibited view of the club head interior 1650 and to highlight the various inventive concepts described herein. In the embodiments illustrated, the golf club head 1100 is formed from four pieces, a face cup 1700, a hosel 1500, a sole 1300, and a crown (not illustrated). The crown comprises the top portion of the golf club head 1100, the sole 1300 comprises the bottom portion of the golf club head 1100, the face cup 1700 comprises the striking face 1400 as well as an upper face cup return 1720 and a lower face cup return 1710, and the hosel 1500 is configured to receive the shaft of the club. The hosel 1500 comprises an external portion 1510 which extends outside the golf club head 1100 and an internal portion 1520 which extends into the golf club head interior 1650. In some embodiments, as illustrated in FIGS. 5-14, the shell 1600 of the golf club head 1100 is welded to the shell engaging hosel portion 1530 of the hosel 1500, which generally separates the external portion 1510 of the hosel 1500 from the internal portion 1520 of the hosel 1500. In additional embodiments, the golf club head 1100 can comprise additional constructions which may include for example, two piece construction, three piece construction, four piece construction, five piece construction, etc. FIG. 15 illustrates one embodiment of a method of constructing a golf club head 1100, which is outlined in more detail below.

The various pieces of the golf club head 1100 can be made from a variety of materials which may include, for example, titanium, steel, aluminum, composite materials such as carbon fiber, etc. The various pieces of the golf club head 1100 can be formed using a variety of techniques which may include, for example, casting, forging, stamping, machining, sintering, vacuum infusion, autoclaving, etc. The marriage of the golf club head 1100 can comprise joining the various pieces of the club head together using a variety of techniques which may include, for example, welding, swaging, brazing, mechanical locking structures, bonding agents such as adhesives, epoxies, resins, etc. Welding, when utilized herein, refers to joining a plurality of structures via melting at least a portion of each structure forming a molten pool which becomes a strong joint once the pool cools. Welding can utilize various sources of heat which may include, for example, a gas flame, an electric arc, a laser, an electron beam, friction, ultrasound, etc.

One of the primary goals of golf club manufacturing is ensuring that characteristics of the golf club head 1100 which may include for example, lie angle, face angle, and loft angle, remain within tolerance during manufacturing. In some cases, during manufacture, the hosel 1500 may not be oriented within tolerance relative to the rest of the golf club head 1100. The rest of the golf club head 1100 can be referred to as the shell 1600 and can include the striking face 1400, sole 1300, and crown. Often, such errors are due to movement or deformation of the various pieces of the club head 1100 during their marriage to form the golf club head 1100. In some embodiments, the characteristics of the golf club head 1100 including lie angle, face angle, and loft angle, can move outside the tolerated range during the marriage of the various pieces of the golf club head, particularly when they are welded together. Thus, after the marriage of the various pieces of the golf club head 1100, the orientation of the hosel 1500 often must be manipulated relative to the shell 1600 of the golf club head 1100 to ensure the golf club head 1100 is within specification.

Figure 5:
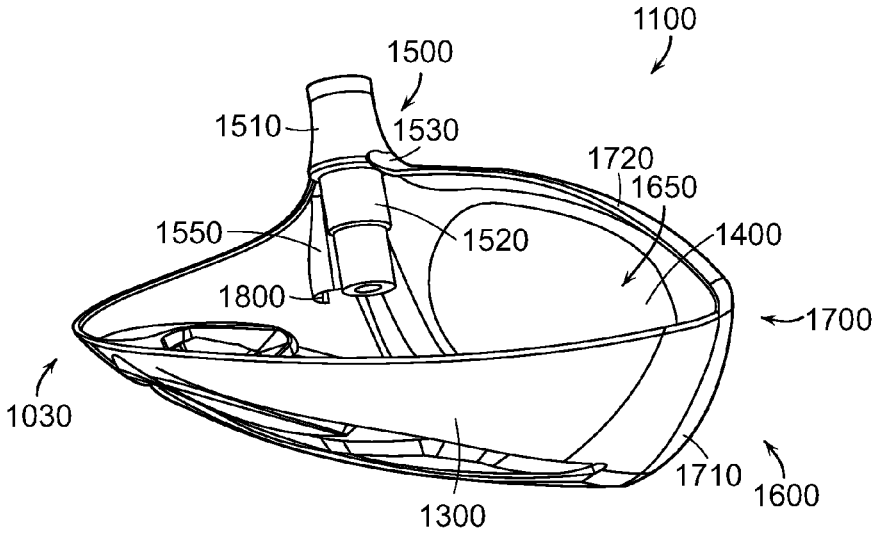
FIG. 5 illustrates a perspective view of one embodiment of a golf club head omitting the crown of the golf club head and including a rib window.

In some embodiments, as illustrated in FIG. 5, the internal portion 1520 of the hosel 1500 does not engage the shell 1600 directly. In some embodiments, the hosel 1500 only directly engages the shell 1600 at the shell engaging hosel portion 1530, providing some flexibility between the hosel 1500 and the shell 1600 and allowing for some manipulation of the hosel 1500 relative to the shell 1600 after affixing the hosel 1500 to the shell 1600 at the shell engaging hosel portion 1530. In some embodiments, including those illustrated in FIGS. 5-10, the golf club head can include a hosel rib 1550. The hosel rib 1550 can comprise an extension of material from the hosel 1500 to bridge the gap between a portion of the hosel 1500 and a portion of the golf club head 1100, which may include for example the shell 1600. The internal portion of the hosel 1520 can then indirectly engage the shell 1600 via the hosel rib 1550 as illustrated in FIG. 10. In some embodiments, the hosel rib 1550 can engage the sole 1300 of the golf club head 1100. In some embodiments, in a five piece construction for example which includes a skirt between the sole and the crown, the hosel rib 1550 can engage the skirt of the golf club head 1100. In additional embodiments, the hosel rib 1550 could engage the striking face 1400, the crown 1200, etc. The hosel rib 1550 can promote additional strength and stiffness between the hosel 1500 and the shell 1600 of the golf club head. The hosel rib 1550 can be particularly useful for altering the acoustic qualities of the golf club head 1100 as it impacts a golf ball. Golfers have become accustomed to particular acoustic sounds for various types of golf clubs. The hosel rib 1550 can allow a golf club manufacturer to manipulate the acoustic characteristics of a golf club to produce a desirable sound by manipulating for example, the frequencies and/or amplitude at which various portions of the golf club head 1100 vibrate when the golf club head 1100 strikes a golf ball.

In some embodiments, as illustrated in FIG. 5, the hosel rib 1550 can extend out from the internal portion 1520 of the hosel 1500. The hosel rib 1550 can extend substantially towards the heel 1010 of the golf club head 1100. In some embodiments, the hosel rib 1550 can extend towards other portions of the shell 1600 which may include for example, the striking face 1400, the sole 1300, the aft portion 1030 of the golf club head 1100, the crown, etc. In some embodiments, as illustrated in FIGS. 5-8, the hosel rib 1550 comprises a substantially rectangular cross section. In other embodiments, the hosel rib 1550 can comprise cross sectional shapes which may include for example, square, triangular, circular, ovular, organic shapes, etc. In some embodiments, the golf club head 1100 can comprise a plurality of hosel ribs 1550.

The hosel rib 1550 can be integrally formed with the hosel 1500. In other embodiments, the hosel rib 1550 can be affixed to the hosel 1500 by a variety of techniques which may include for example, welding, swaging, brazing, mechanical locking structures, bonding agents such as adhesives, epoxies, resins, etc. The hosel rib 1550 can be affixed to a portion of the shell 1600 of the golf club head 1100 as well, which may include for example, the sole 1300. In some embodiments, the hosel rib 1550 can be affixed to a portion of the shell 1600 of the golf club head 1100 during the same stage of construction as the marriage of the golf club head 1100. One problem with a hosel rib 1550 which is affixed to both the hosel 1500 and the shell 1600 of the golf club head 1100, is that adjusting the hosel 1500 orientation relative to the shell 1600 of the golf club head 1100 after joining the various pieces of the golf club head 1100 together, becomes difficult due to the inflexibility of the hosel 1500 relative to the shell 1600 of the golf club head 1100.

In some embodiments, the hosel rib 1550 is not affixed to the shell 1600 of the golf club head 1100 during the marriage of the golf club head 1100, thus maintaining some flexibility between the hosel 1500 and the shell 1600 of the golf club head 1100. The hosel 1500 can then be manipulated relative to the shell 1600 after the marriage to achieve the desired golf club characteristics. The problem then becomes, affixing the hosel rib 1550 to the shell 1600 of the golf club head 1100 after the marriage, as the marriage may have made it difficult or impossible to access the golf club head interior 1650.

Figure 6:
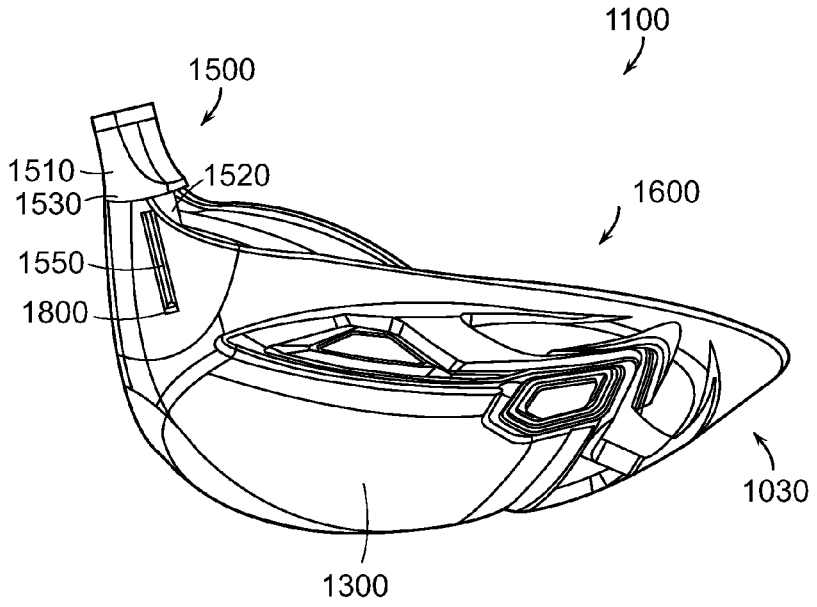
FIG. 6 illustrates an additional perspective view of the golf club head of FIG. 5.
Figure 7:
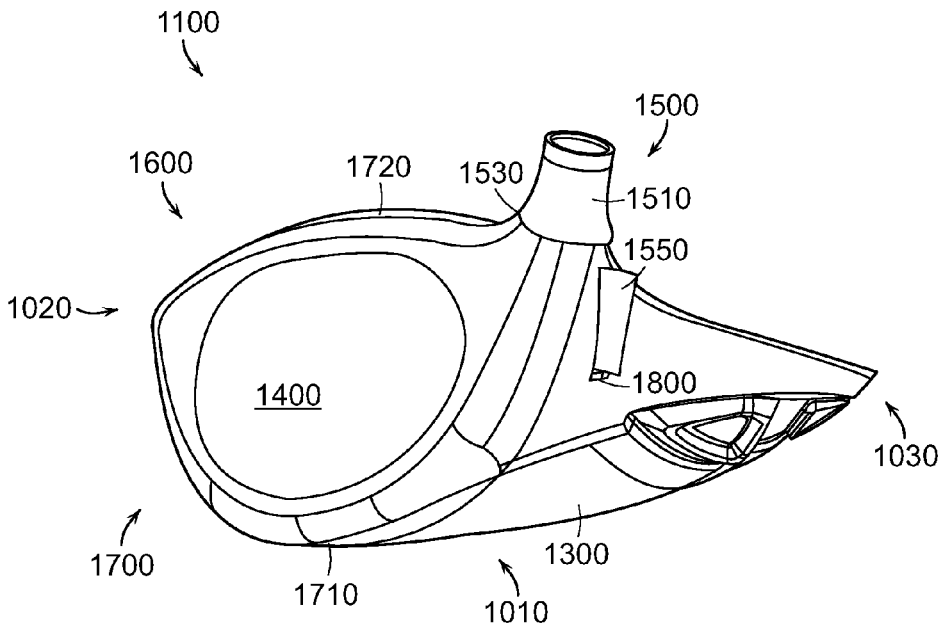
FIG. 7 illustrates an additional perspective view of the golf club head of FIG. 5.

In some embodiments, as illustrated in FIGS. 5-7, the shell 1600 of the golf club head 1100 can include a rib window 1800. The rib window 1800 can be configured to receive at least a portion of the hosel rib 1550. In some embodiments, the rib window 1800 can be formed through the shell 1600 of the golf club head 1100. The rib window 1800 can be formed through the sole 1600 of the golf club head 1100. The rib window 1800 can be formed through a portion of the heel 1010 of the golf club head 1100. The hosel rib 1550 can be dimensioned such that when the hosel 1500 is affixed to the shell 1600 of the golf club head 1100, a portion of the hosel rib 1550 extends into the rib window 1800. In some embodiments, the hosel rib 1550 can be dimensioned such that when the hosel 1500 is affixed to the shell 1600 of the golf club head 1100, a portion of the hosel rib 1550 extends through the rib window 1800 extending outside the shell 1600 of the golf club head 1100, as illustrated in FIG. 7. The rib window 1800 can be dimensioned such that the hosel rib 1550 can be manipulated relative to the shell 1600 of the golf club head 1100 after the marriage of the various pieces of the golf club head 1100, with the hosel rib 1550 moving relative to the rib window 1800 as the hosel 1500 is bent into the desired orientation. In other embodiments, the hosel rib 1550 may not pass through the rib window 1800, but the rib window 1800 may provide a window to affix the hosel rib 1550 to the shell 1600. In some embodiments, the shell 1600 can include multiple rib windows 1800.

Figure 8:
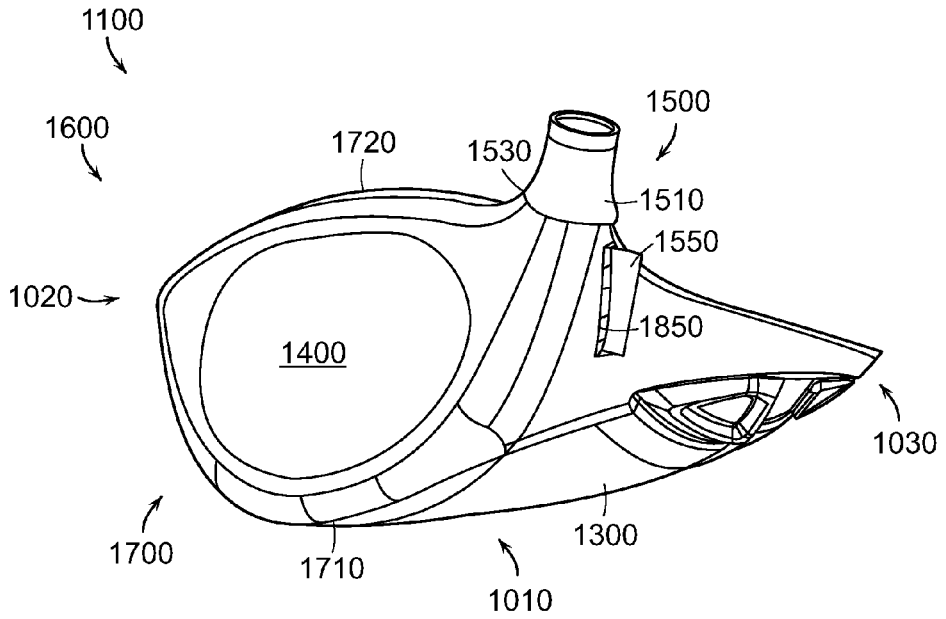
FIG. 8 illustrates an additional perspective view of the golf club head of FIG. 5 with the hosel rib affixed to the shell.

In some embodiments, as illustrated in FIG. 8, once the manipulation of the hosel 1500 has been completed and is within specification, the hosel rib 1550 can be affixed to the shell 1600 of the golf club head 1100. In some embodiments, as illustrated in FIG. 8, affixing the hosel rib 1550 to the shell 1600 of the golf club head 1100 can include welding the hosel rib 1550 to the shell 1600 of the golf club head 1100, forming a weld bead 1850. The welding process can fill in any remaining portions of the rib window 1800 not filled by the hosel rib 1550, eliminating any gaps between the hosel rib 1550 and the shell 1600.

Figure 9:
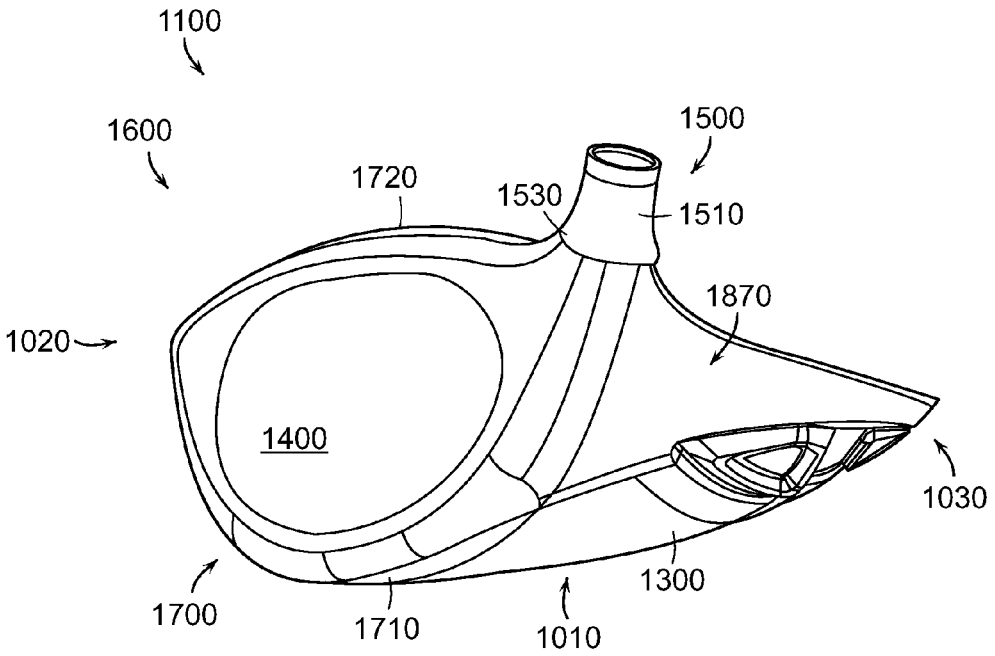
FIG. 9 illustrates an additional perspective view of the golf club head of FIG. 5 after a finishing process.
Figure 10:
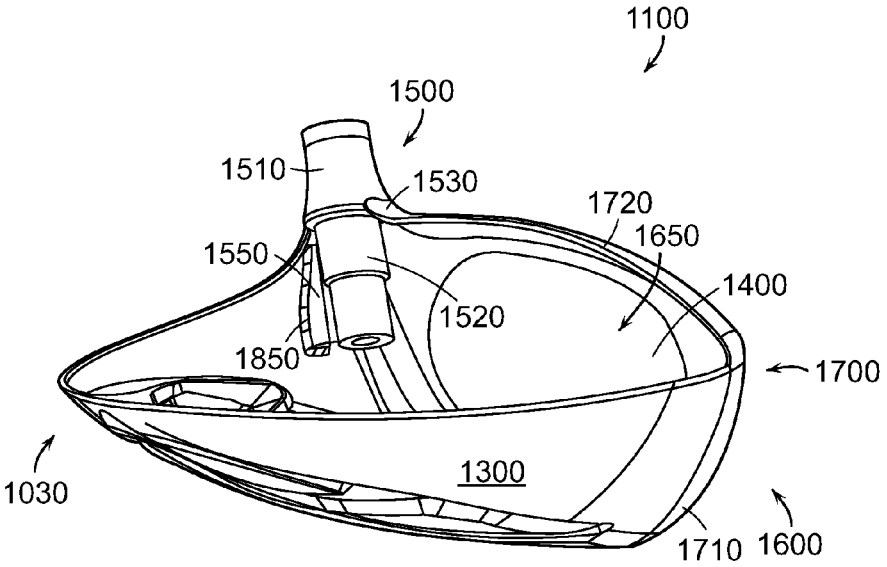
FIG. 10 illustrates an additional perspective view of the golf club head of FIG. 5 with the hosel rib affixed to the shell.

Then, in some embodiments, as illustrated in FIG. 9, excess weld bead 1850 formed by welding the hosel rib 1550 to the shell 1600 of the golf club head 1100 as well as any portion of the hosel rib 1550 extending outside the outer surface of the shell 1600 of the golf club head 1100 can be removed via a finishing process. In some embodiments, the finishing process can include one or a combination of techniques which may include, for example, grinding, polishing, sanding, cutting etc. The rib window 1800, portion of the hosel rib 1550 extending through the rib window 1800, and excess weld bead 1850, can then be replaced by a polished area 1870 as illustrated in FIG. 10. In some embodiments, the polished area 1870 can appear consistent with the rest of the shell 1600, with any immediately apparent evidence of the hosel rib 1550 and weld bead 1850 removed by the finishing process.

Figure 11:
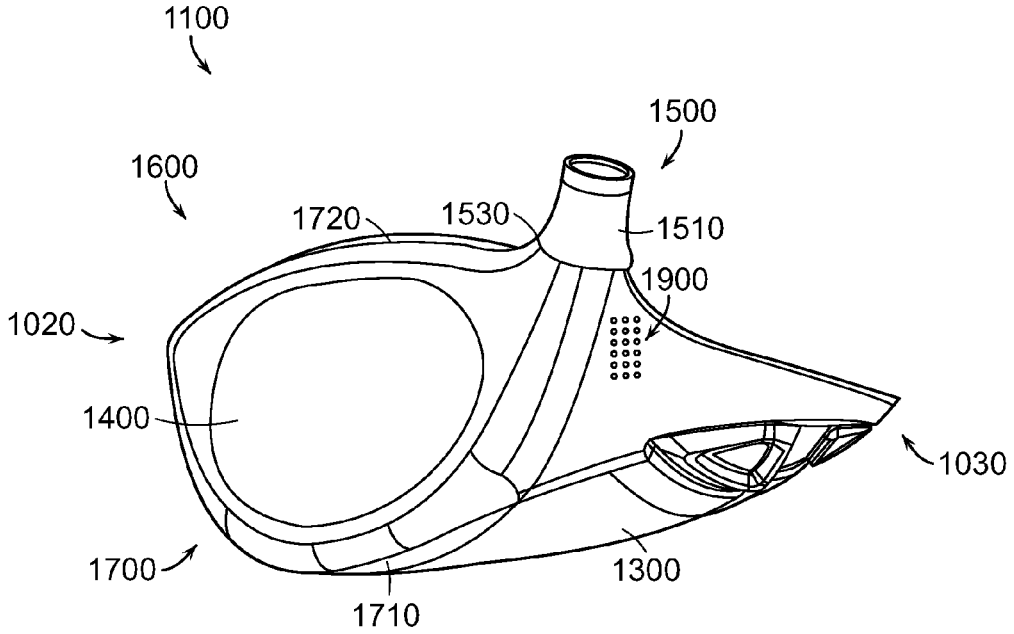
FIG. 11 illustrates a perspective view of one embodiment of a golf club head omitting the crown of the golf club head and including a plurality of affixation ports.

In some embodiments, as illustrated in FIG. 11, rather than including a rib window, the shell 1600 can include a plurality of affixation ports 1900. In some embodiments, the affixation ports 1900 can comprise holes formed through the shell 1600. The affixation ports 1900 can be circular in cross section. The affixation ports 1900 can allow the hosel rib 1550 to be affixed to the shell 1600 after the marriage of the shell 1600 and after the manipulation of the hosel 1500 has been completed and is within specification. The plurality of affixation ports 1900 can be positioned such that hosel rib 1550 is within an affixable proximity to at least one, and preferably several of the affixation ports 1900, even after manipulating the hosel 1500 relative to the shell 1600 of the golf club head 1100.

Figure 12:
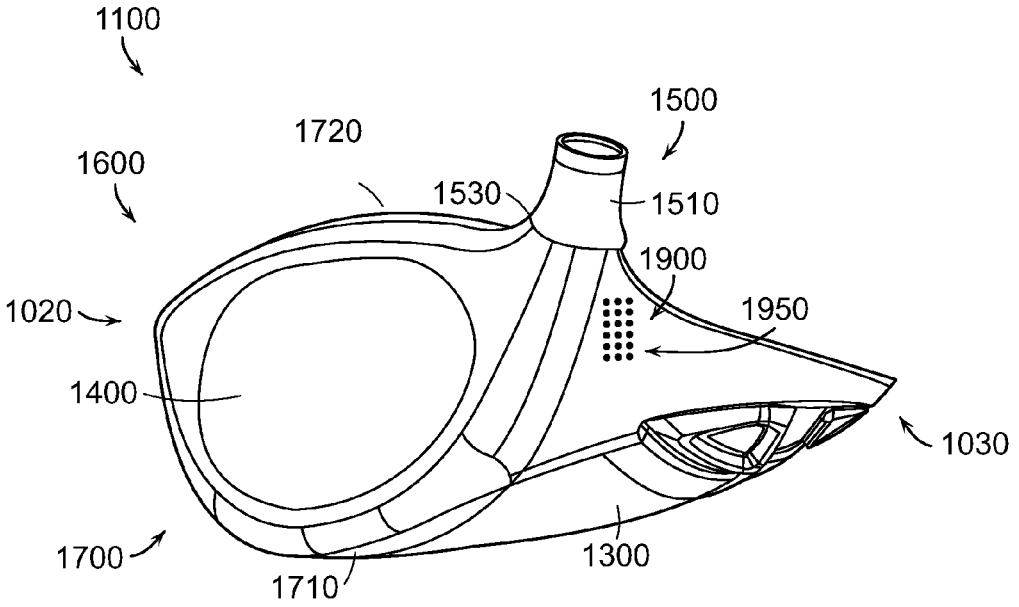
FIG. 12 illustrates an additional perspective view of the golf club head of FIG. 11 with the hosel rib affixed to the shell.

In some embodiments, as illustrated in FIG. 12, each affixation port 1900 can be utilized for a spot weld 1950. Depending on the position of the hosel rib 1550 relative to the shell 1600, one or more of the spot welds 1950 can engage the hosel rib 1550 and affix the hosel rib 1550 to the shell 1600 as illustrated in FIG. 14. Then, in some embodiments, as illustrated in FIG. 13, excess spot weld 1950 formed by welding the hosel rib 1550 to the shell 1600 of the golf club head 1100 can be removed via a finishing process forming a polished area 1970.

In other embodiments, affixing the hosel rib 1550 to the shell 1600 of the golf club head 1100 can include other means of fixation which may include for example, swaging, brazing, mechanical locking structures, bonding agents such as adhesives, epoxies, resins, etc. In some embodiments, one or more pieces of the golf club head 1100 including for example, the hosel 1500, the crown, the sole 1300, the striking face 1400, the hosel rib 1550, etc. can comprise a composite material which may include for example, carbon fiber. In some embodiments, the finishing process can include adding additional materials over the rib window 1800 area or affixation port 1900 area to further camouflage the existence of the rib window 1800 or affixation ports 1900.

In describing the present technology herein, certain features that are described in the context of separate implementations also can be implemented in combination in a single implementation. Conversely, various features that are described in the context of a single implementation also can be implemented in multiple implementations separately or in any suitable sub combination. Moreover, although features may be described above as acting in certain combinations and even initially claimed as such, one or more features from a claimed combination can in some cases be excised from the combination, and the claimed combination may be directed to a sub combination or variation of a sub combination.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure as well as the principle and novel features disclosed herein.

We claim:

1. A method of constructing a golf club head, comprising:

affixing a hosel to a shell;

wherein said shell comprises a striking face, a sole extending aftward from a lower edge of said ball striking face, and a crown extending aftward from an upper edge of said ball striking face;

wherein said shell defines a golf club head interior within said shell;

wherein said hosel is configured to receive a golf club shaft;

wherein said hosel comprises an internal portion within said golf club head interior and an external portion extending outside said shell;

wherein said golf club head comprises a hosel rib permanently affixed to said internal portion of said hosel;

manipulating the orientation of said hosel relative to said shell after affixing said hosel to said shell; and affixing said hosel rib to said shell after manipulating the orientation of said hosel;

wherein said step of affixing said hosel rib to said shell consists of at least one of welding, swaging, brazing, and bonding.

2. The method of constructing a golf club head of claim 1, wherein said shell comprises a rib window aligned with said hosel rib and configured to receive at least a portion of said hosel rib.

3. The method of constructing a golf club head of claim 2, wherein at least a portion of said hosel rib extends into said rib window and affixing said hosel rib to said shell comprises affixing said portion of said hosel rib extending into said rib window to a portion of said shell adjacent said rib window.

4. The method of constructing a golf club head of claim 3, wherein at least a portion of said hosel rib extends outside said shell of said golf club head and said method of constructing a golf club head further comprises removing said portion of said hosel rib extending outside said shell of said golf club head.

5. The method of constructing a golf club head of claim 3, further comprising the marriage of a plurality of pieces to form said shell.

6. The method of constructing a golf club head of claim 5, wherein said marriage comprises welding said plurality of pieces together, wherein affixing said hosel to said shell comprises welding said hosel to said shell, and wherein said marriage occurs prior to said manipulation of the orientation of said hosel relative to said shell.

7. The method of constructing a golf club head of claim 4, wherein affixing said hosel rib to said shell comprises welding said hosel rib to said shell and wherein said method of constructing said golf club head further comprises a finishing process.

8. The method of constructing a golf club head of claim 6, wherein said hosel rib limits the orientation of said hosel from changing relative to said shell after said hosel rib is affixed to said shell.

9. The method of constructing a golf club head of claim 8, wherein affixing said hosel rib to said shell comprises affixing said hosel rib to said sole.

10. The method of constructing a golf club head of claim 9, wherein said hosel rib extends away from said hosel in a substantially heelward direction.

11. The method of constructing a golf club head of claim 10, wherein said hosel rib is configured to manipulate the acoustic qualities of said golf club head.

12. The method of constructing a golf club head of claim 8, wherein said hosel rib is substantially rectangular in cross section.

13. The method of constructing a golf club head of claim 4, wherein said step of removing said portion of said hosel rib extending outside said shell consists of at least one of grinding, polishing, sanding, and cutting.

14. A method of constructing a golf club head, comprising:

affixing a hosel to a shell;

wherein said shell comprises a striking face, a sole extending aftward from a lower edge of said ball striking face, and a crown extending aftward from an upper edge of said ball striking face;

wherein said shell defines a golf club head interior within said shell;

wherein said hosel is configured to receive a golf club shaft;

wherein said hosel comprises an internal portion within said golf club head interior and an external portion extending outside said shell;

wherein said golf club head comprises a hosel rib affixed to said internal portion of said hosel;

wherein said shell comprises a plurality of affixation ports, said affixation ports comprising holes passing through said shell;

manipulating the orientation of said hosel relative to said shell after affixing said hosel to said shell;

affixing said hosel rib to said shell after manipulating the orientation of said hosel; and wherein affixing said hosel rib to said shell comprises adding a spot weld to each affixation port, at least one of said spot welds engaging said hosel rib.

15. A golf club head, comprising:

a shell comprising a striking face;

a sole extending aftward from a lower edge of said ball striking face;

a crown extending aftward from an upper edge of said ball striking face;

a golf club head interior within said shell;

a hosel affixed to a heel side of said shell, said hosel configured to receive a golf club shaft;

wherein said hosel comprises an internal portion extending into said golf club head interior and an external portion extending outside said shell; and a hosel rib permanently affixed to said internal portion of said hosel and to said shell wherein said hosel rib is permanently affixed to said shell via at least one of welding, swaging, brazing, and bonding.

16. The golf club head of claim 15, wherein said hosel rib limits the orientation of said hosel from changing relative to said shell.

17. The golf club head of claim 16, wherein said hosel rib is affixing to said sole.

18. The golf club head of claim 17, wherein said shell comprises a plurality of pieces welded together and wherein said hosel is welded to said shell at a shell engaging hosel portion defining the border between said internal portion of said hosel and said external portion of said hosel.

19. The golf club head of claim 18, wherein said hosel rib is welded to said shell.

20. The golf club head of claim 19, wherein said internal portion of said hosel does not directly engage said shell, and wherein said internal portion of said hosel indirectly engages said shell via said hosel rib.

* * * * *